US006182040B1

(12) United States Patent
Monaco

(10) Patent No.: US 6,182,040 B1
(45) Date of Patent: Jan. 30, 2001

(54) VOICE-SYNTHESIZER RESPONSIVE TO PANEL DISPLAY MESSAGE

(75) Inventor: Dino Monaco, Sicklerville, NJ (US)

(73) Assignees: Sony Corporation, Tokyo (JP); Sony Electronics, Inc., Park Ridge, NJ (US)

( * ) Notice: Under 35 U.S.C. 154(b), the term of this patent shall be extended for 0 days.

(21) Appl. No.: 09/082,147

(22) Filed: May 21, 1998

(51) Int. Cl.[7] ..... G10L 13/08
(52) U.S. Cl. ..... 704/260
(58) Field of Search ..... 704/258, 270, 704/272–276

(56) References Cited

U.S. PATENT DOCUMENTS 4,399,331 * 8/1983 Brown et al. ..... 379/42
4,674,112 * 6/1987 Kondraske et al. ..... 379/96
4,749,353 * 6/1988 Breedlove ..... 434/169
4,821,027 * 4/1989 Mallory et al. ..... 340/521
4,825,385 * 4/1989 Dolph et al. ..... 364/513.5
4,868,750 * 9/1989 Kucera et al. ..... 364/419
4,987,402 * 1/1991 Nykerk ..... 340/426
5,210,689 * 5/1993 Baker et al. ..... 364/419
5,679,001 * 10/1997 Russell et al. ..... 434/185
5,791,904 * 8/1998 Russell et al. ..... 434/185
5,820,386 * 10/1998 Sheppard, II ..... 434/322
5,884,256 * 3/1999 Bennett et al. ..... 704/235
5,890,122 * 3/1999 Van Kleck et al. ..... 704/275

* cited by examiner

*Primary Examiner*—Krista Zele
*Assistant Examiner*—Michael N. Opsasnick
(74) *Attorney, Agent, or Firm*—Ronald P. Kananen; Rader, Fishman & Grauer

(57) ABSTRACT

A voice-synthesizer driven by matrix-type panel displays of the type that present alpha-numeric characters captures all or part of the digital values that are used to drive the message display and uses the so-capture information to address a look-up table (44) that outputs a series of digital values to a voce-synthesizer (30). The process is triggered by an alarm status signal so that the voce-synthesizer (30) functions to articulate an alarm message and not articulate non-alarm messages.

13 Claims, 5 Drawing Sheets

VOICE-SYNTHESIZER RESPONSIVE TO PANEL DISPLAY MESSAGE

BACKGROUND OF THE INVENTION

The present invention relates to a voice-synthesizer system for various types of industrial equipment of the type that display visual information to operating personnel.

Various types of industrial process equipment have been designed with panel-type alpha-numeric character displays that utilize standardized character display protocols to display individual characters on, for example, a liquid crystal display, with groups of individual characters defining words or multi-word messages.

In addition to the use of displays that are intended to be read by operating personnel, it is not uncommon for the equipment to also include audio alarm-annunciators to sound an alarm to warn the operating personnel of a selected number of undesired operating conditions. In those types of equipment that utilize audio alarm-annunciators and multi-character displays, the audio alarm annunciates an alarm condition after which the operator(s) read the displayed message. Typically, the audio alarm annunciator will sound a warning for high-priority conditions that require immediate corrective action(s) and also sound for lower-priority conditions that do not require an immediate response from operating personnel. In this situation, it is not uncommon for operating personnel to spend a considerable amount of time addressing lower-priority alarm conditions that do not require immediate attention. Accordingly, system operators must often interrupt the task at hand to address all alarm conditions, including relatively rare high-priority alarms and the many lower-priority alarm conditions that arise. This situation can lead to occasions during which alarms are ignored because of an assumption on the part of the operating personnel that a particular alarm is a lower-priority alarm for which a response can be deferred.

It would be desirable for those industrial control systems that utilize character displays and audio-alarm annunciators to also incorporate a voice synthesizer to announce the alarm conditions in spoken words. In general, existing systems include complex internal computer control systems in which retro-fitting voice-synthesizer devices can be problematic.

SUMMARY OF THE INVENTION

In view of the above, it is an object of the present invention, among others, to provide a voice-synthesizer annunciator for industrial control systems of the type that include message displays defined by alpha-numeric character displays.

It is another object of the present invention to provide a voice-synthesizer annunciator retrofit system for industrial control systems driven by character-by-character displays.

It is still another object of the present invention to provide a voice-synthesizer system for industrial control systems driven by the signals that drive the matrix-type display(s) of the system.

In accordance with the present invention, a voice-synthesizer operates in response to the signals used to drive visual character displays. Thus, an audio message that corresponds to a visually displayed message can be articulated, prefereably in response to a pre-selected alarm condition. In this way, the system operator(s) can assess the priority of an alarm condition and determine whether an alarm condition is a high-priority alarm requiring immediate attention or a lower-priority alarm for which a responsive action on the part of the operator can be deferred. In accordance with the present invention, the voice-synthesizer and its related drive circuits are enabled only upon detection of an alarm condition so that only alarm messages are synthesized into spoken words.

In one embodiment of the invention, all or part of the signals that drive the column and row lines of a matrix-type display are used to address a look-up table that outputs a sequence of word-selection signals for a particular message to a voice-synthesizer that articulates audio messages in response to the word-selection signals. In addition to being implemented by discrete logic devices, the invention may likewise be implemented by stored-program processor-controlled devices or a combination thereof.

The present invention advantageously provides a voice-synthesizer driven by the drive signals that also drive the alpha-numeric character displays. The system is well-suited for retrofitting to existing equipment that utilize matrix-type panel displays.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
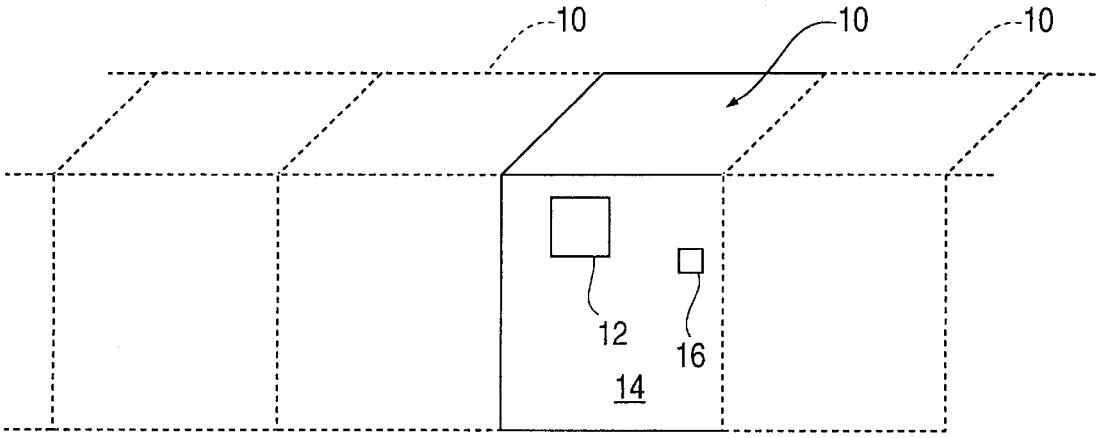
FIG. 1 is a perspective view of generic industrial equipment to which the voice-synthesizer of the present invention is to be adapted.

The present invention is designed to function in the environment of any type of equipment that includes a panel-type display for displaying information to an operator and, optionally, an audio annunciator that signals the presence of an alarm condition corresponding to the displayed information or message. As shown in FIG. 1, an exemplary equipment 10 includes a panel display 12 (described more fully below) on the front panel 14 of the equipment 10 and, additionally, an audio annunciator 16. The panel display 12, typically under the control of a central processor or controller (not shown), presents various alpha-numeric messages to the operator(s) of the equipment 10. The annunciator 16 functions to sound an audio warning alarm to the operator(s) when the message being displayed is a message that warrants the sounding of an alarm condition. As represented in dotted-line illustration on the opposite sides of the equipment 10, the equipment 10 may be part of a larger installation of similar or dissimilar equipment designed to operate for a common purpose, some or all or the equipment of the larger installation may also include respective panel displays and audio annunciators (not specifically shown).

In the preferred embodiment, the equipment 10 is a compact disc (CD) mastering system known as the Sony Lean Integrated Mastering System (SLIM) sold by the Production Technology Group of the Sony Corporation, Tokyo, Japan. The equipment 10 is designed to manufacture masters used in the manufacture of compact discs and controls a number of process steps and inter-step transfers of preforms that are processed into the finished masters. While not specifically illustrated, the SLIM includes a Glass Master Machine, a Master Code Cutter, a Resist Master Machine, and a Recycle Cleaning Machine. As can be appreciated by those skilled in the art, the present invention is not limited to the equipment 10 of the preferred embodiment and can be adapted to or combined with a wide variety of equipments that incorporate an alpha-numeric display and an alarm annunciator.

Figure 2:
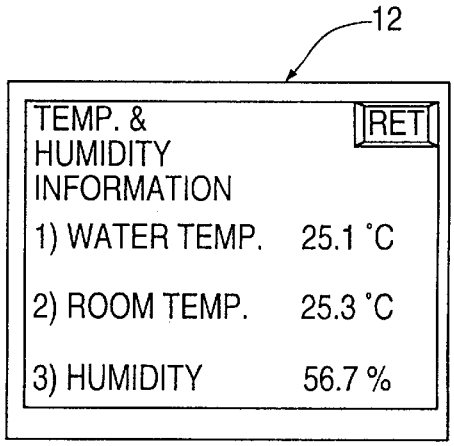
FIG. 2 is a frontal view of an alpha-numeric character display presenting a non-alarm status message, the particular message being representative of a much larger set of non-alarm messages that can be displayed.
Figure 3:
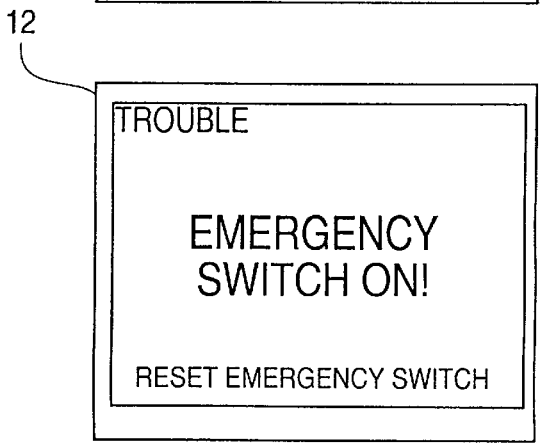
FIG. 3 is a frontal view of the alpha-numeric character display of FIG. 2 presenting an alarm status message, the particular message being representative of a much larger set of alarm messages that can be displayed.

As shown in FIGS. 2 and 3, the panel display 12 is designed to display various messages for the equipment operator(s). As shown in FIG. 2, a number of non-alarm status messages can be displayed, the exemplary message shown represent temperature/humidity conditions. As shown on the upper right in FIG. 2, the panel display 12 can be of the touch-screen type in which a "button" area or zone (viz., "RET") is displayed and, when that "button" is touched by the operator, a desired response or control function is effected. The non-alarm status information shown in FIG. 2 is representative of numerous non-alarm status screens that can be displayed to the equipment operator(s).

A representative 'alarm' message is shown in FIG. 3 and indicates the status of an emergency switch as in the 'ON' state. The message shown is merely representative of a larger set of messages that can be considered alarm states including messages related to over/under temperature conditions, the level of various fluids, the concentration of various chemical baths, the open/close status of various doors, and the like. For every message that is deemed to be an alarm message, the audio annunciator 16 will sound an audio alarm for the equipment operators. The audio alarm can be a one-time annunciation, a series of intermittent sounds, or a continuous sound.

Figure 4:
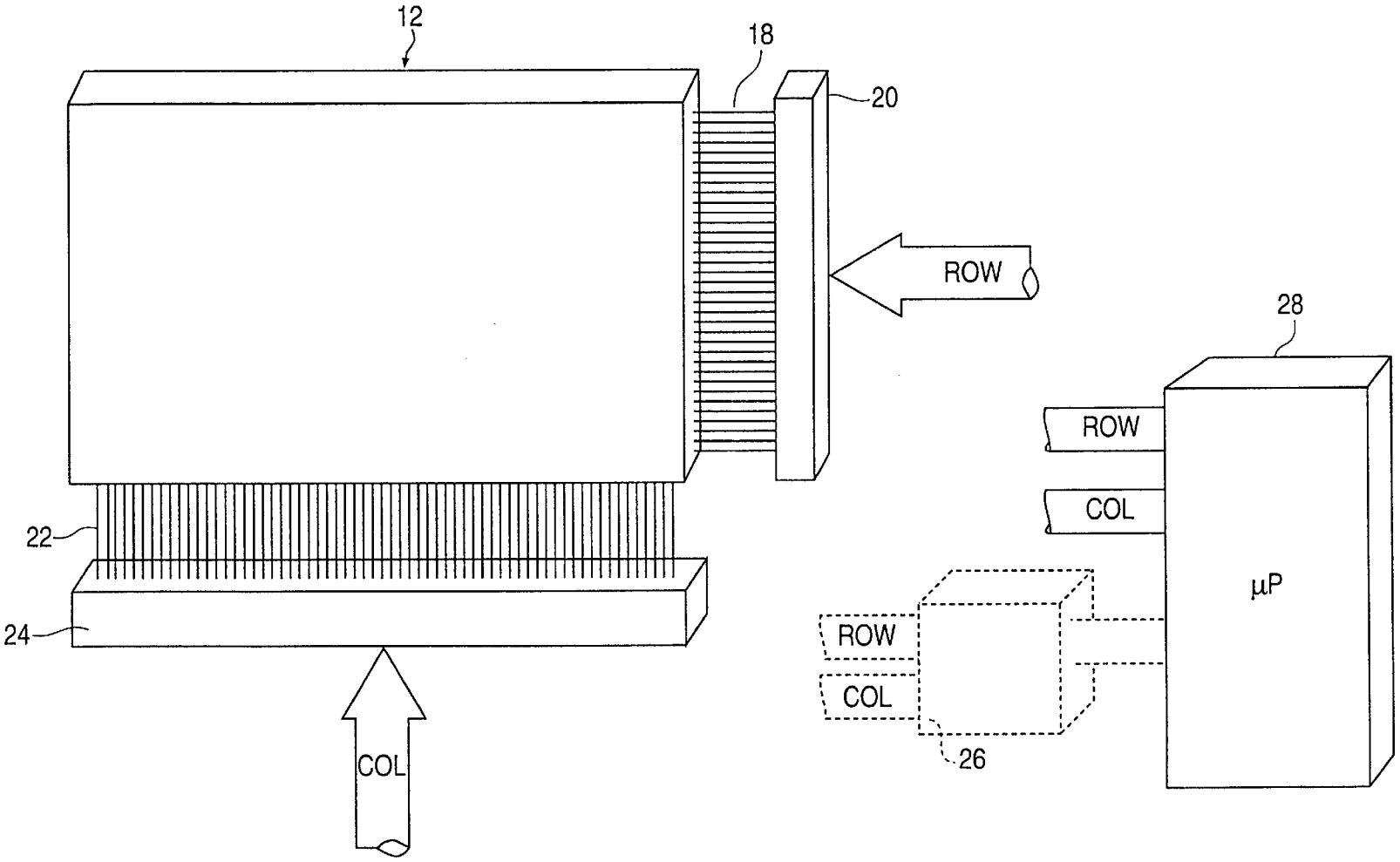
FIG. 4 is a generic view of an exemplary flat panel matrix-type display for displaying either alarm or non-alarm messages.

FIG. 4 presents a generic matrix panel-type display; as is known in the art, these types of displays typically include a plurality of spaced parallel column lines that intersect orthogonally with a plurality of spaced parallel row lines. The intersection of each pair of row/column lines represents a pixel. Depending upon the type of display, a pixel will function to provide a visually obserable picture element to an observer when its corresponding row and columns lines are actuated or otherwise activated. For example, for liquid crystal displays, the liquid crystal material present at the intersection of the row/column lines undergoes an electro-optic change to present a visable picture element to an observer. The LCD can be of the twisted-nematic type, the dichoric-dye guest-host type, the active-matrix type, back-lite light-valve type, or the ferroelectric-bistable types. Other types of panel displays include the electroluminescent type in which sharply pointed electrodes at each pixel position discharge electrons towards a phosphor screen to produce a visual picture element when the row/column lines for that pixel are appropriately driven. More recent displays include light-emitting diode panels and/or laser diode panels with one or more light-emitting diodes or laser diodes at each 20 pixel position and which emit light when the row/column lines for a particular pixel are accessed by their drive circuitry. Other technologies include the use of thinfilm transistor (TFT) displays in which a transistor and charge-carrying capacitor are located at each pixel position. As is apparent, the present invention can be used in the context of panel displays of currently known technologies as well as panel displays that represent extensions of pixel forming technologies and new pixel forming technologies.

As shown in FIG. 4, the row-lines 18 are connected to a row-driver 20 and the column-lines 22 are connected to a column-driver 24. As is known in the art, the drivers operate to apply a voltage, current, or charge to one or more lines or connect or disconnect a line from a ground potential or other potential in order to cause an addressed pixel to generate a visually observable picture element. The particular manner by which the row and column line for a particular pixel is actuated, operated, or made to function to provide a visually observable picture element is dependent upon the particular technology. In the context of a simple, twisted nematic liquid-crystal display, a particular pixel is turned "ON" or "OFF" with the presence or absence of an applied electric field between the row line and the column line for that pixel. In addition and depending upon the particular display technology, the row and column lines can be driven by strobing, i.e., the row and column lines are actuated periodically rather than in a continuous manner.

In general, where messages are of a fixed nature, a message generator 26 (dotted-line illustration) can be interposed between the processor 28 and the display 12 so that the processor 28 can specify a particular message to be displayed using a multi-bit input value to the message generator 26, with the message generator 26 outputting the corresponding row and column drive signals.

Figure 5:
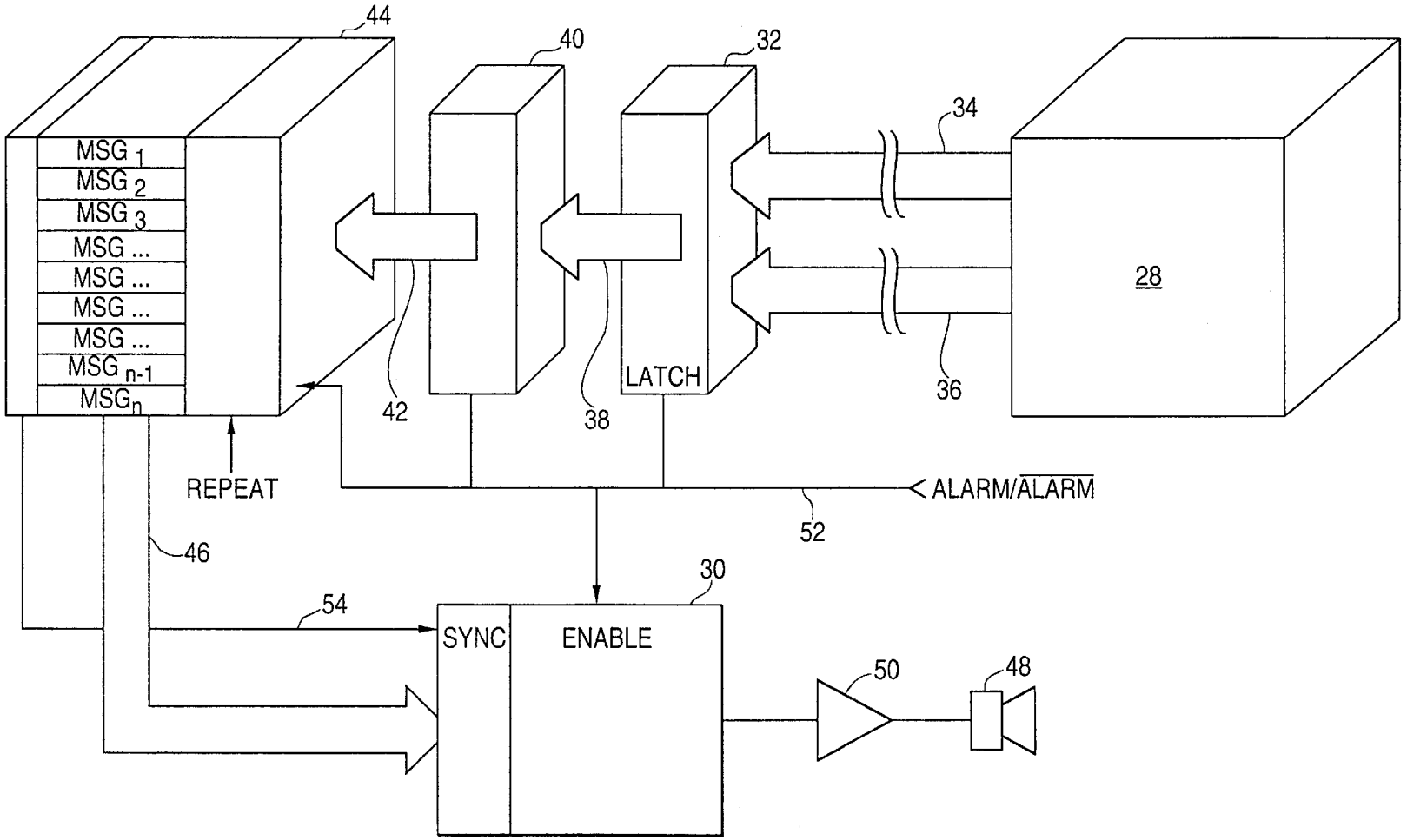
FIG. 5 is a schematic block diagram of a system for capturing digital values that drive the display of FIG. 4 for annunciating alarm messages.

FIG. 5 illustrates a functional block diagram in accordance with the present invention for capturing all or part of a particular alarm message and then using that captured information to drive a voice-synthesizer 30. As shown in FIG. 5, the system includes a row/column word memory 32 that accepts (as parallel inputs) the row/column information from the row-driver 20 and the column-driver 24 via a row bus 34 and a column bus 36, respectively. The word memory 32 outputs via an address bus 38 to a address selector 40 which, in turn, outputs via a look-up table bus 42 to a look-up table 44. The look-up table 44 then outputs via a voice-synthesizer bus 46 to the commercially available voice-synthesizer 30 which, in turn, connects to a loudspeaker 48. If desired, an audio amplifier 50 may be interposed between the output of the voice-synthesizer 30 and the loudspeaker 48. Each of the word memory 32, address selector 40, look-up table 44, and the voice-synthesizer 30 have respective enable/enable inputs that connect to a alarm signal line 52 that carries the ALARM signal. Additionally, a line designated generically as a sync-line 54 connects the look-up table 44 to the voice-synthesizer 30.

The word memory 32 can take the form of a multi-bit register, buffer, or contiguous positions within a RAM. A 'latch' input to the word memory 32 allows the information presented to the word memory 32 to be latched or stored therein in response to an appropriate ALARM command provided on the alarm-signal line 52, as explained below. The word memory 32 outputs to the address selector 40, which, in turn, accepts the stored information in the word memory 32 and converts that stored information into an address or series of addresses that are presented to the look-up table 44. The look-up table 44 includes an addressable series of stored-message values, $Msg_1$, $Msg_2$, $Msg_3$, . . . . $Msg_{n-1}$, $Msg_n$, each message value corresponding to a particular alarm-condition message.

In general, the voice-synthesizer 30 has a vocabulary of individual words with each word produced in response to a unique multi-bit word that is inputted into the voice-synthesizer 30 via the voice-synthesizer bus 46. In the look-up table 44, each stored message, $Msg_1$, $Msg_2$, $Msg_3$, . . . . $Msg_{n-1}$, $Msg_n$, constitutes a series of unique multi-bit words that correspond to the desired message.

In operation, the row and column drive values are presented to the word memory 32 from either the processor 28 or the message generator 26 (FIG. 4). When the processor 28 presents an ALARM signal on the alarm-signal line 52 that is intended to actuate the audio alarm annunciator 16, that same signal (either in its original form or in an appropriately processed form) latches the row/column information into the word memory 32 and also enables the address selector 40 which outputs a unique value corresponding to that alarm message. The unique value outputted by the address selector 40 then functions as an address for the look-up table 44 which, in turn, selects one the available messages, e.g., message Msgn. Thereafter, a series of multi-bit words corresponding to the words of the alarm message, $Msg_{n-1}$, being displayed are outputted via the voice-synthesizer bus 46 into the voice-synthesizer 30 with the sync/trigger signal provided along the sync-line 54 controlling the loading of the successive multi-bit words into the voice-synthesizer 30. The voice-synthesizer 30 then outputs the audio words that correspond to the displayed alarm message. A REPEAT input to the look-up table 44 can cause the addressed message, $Msg_{n-1}$, to be repeatedly outputted in a recurring manner if desired.

The above-described system has a number of advantages, particularly in those cases in which it is desired to retro-fit existing equipment with the system of the present invention. In particular, the voice-synthesizer is driven by a set of signals that also drive the panel display so that a digital analyzer can be used to determine the multi-bit word that corresponds to the row/column values for a particular alarm message. Once the particular word is uniquely determined for each of the known alarm messages, the address selector and the look-up table can be easily programmed with the appropriate information. While interception of the row and column values for a particular message is the preferred form of the invention, as can be appreciated, any digital value in the equipment that provides a unique digital value corresponding to the displayed message can likewise be used. Since the system is enabled by the ALARM message, the voice-synthesizer operates only to articulate alarm conditions and not articulate non-alarm status messages.

Figure 6:
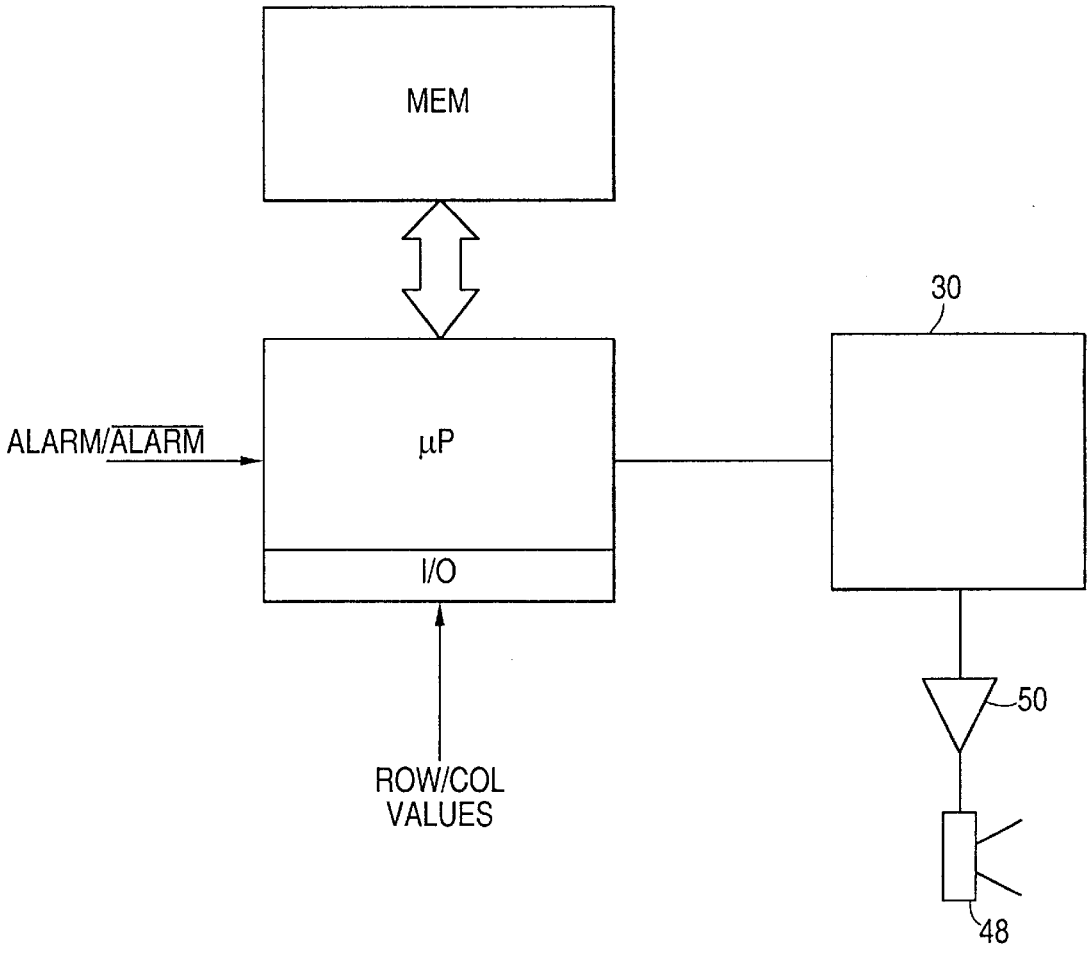
FIG. 6 is a simplified schematic block diagram of a microprocessor-based system for implementing the present invention.
Figure 7:
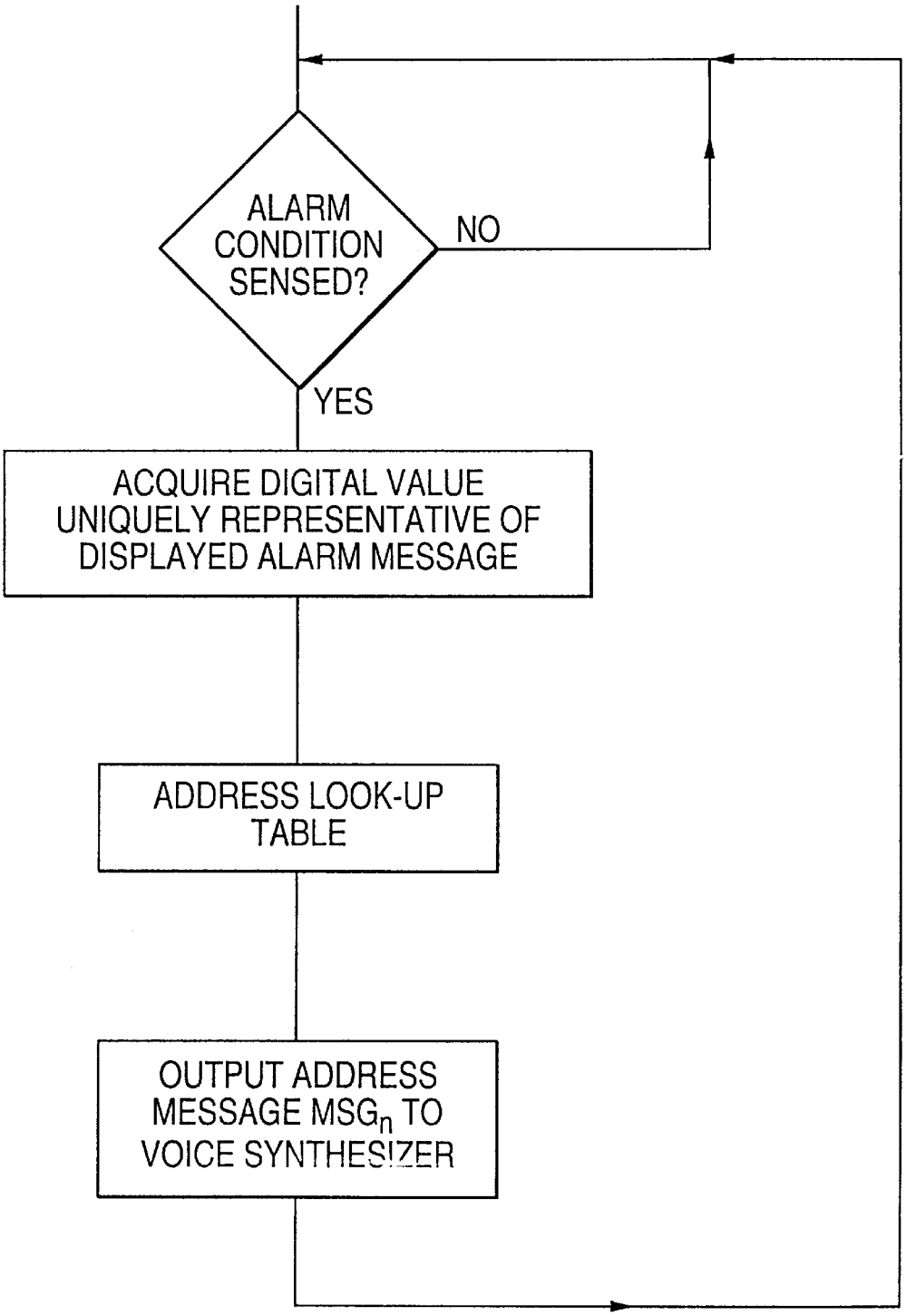
FIG. 7 is a flow diagram illustrating a preferred logic flow path for implementing the present invention.

The subject matter of FIG. 5 represents a discrete logic approach to the present invention. As can be appreciated by those skilled in the art, the logic of FIG. 5 can be implemented in a firmware-driven processor and related devices. As shown in the block diagram of FIG. 6 and in the flow diagram of FIG. 7, a preferred process flow controller involves monitoring the alarm status line for an alarm indication, capturing or otherwise acquiring all or a subset of the digital values for the message displayed, and using the so-acquired digital value to address a look-up table or its equivalent and then outputting that looked-up message to the voice-synthesizer.

In the description above, the system has been described as using both the row and column values for a message for inputting into the word memory. As can be appreciated and depending upon the particular application, it may possible to use only every other row line value and/or every other column value (or only every second, third, etc. row/column value) to nonetheless ascertain a set of row/column bits that uniquely identify each alarm message. Additionally, it may be desirable to use only row values or only column values (or some subset thereof) to uniquely identify each message. These latter approaches reduce the bus and memory sizes and the number of bits that must be manipulated.

As will be apparent to those skilled in the art, various changes and modifications may be made to the illustrated voice-synthesizer driven by panel displays of the present invention without departing from the spirit and scope of the invention as determined in the appended claims and their legal equivalent.

What is claimed is:

1. A voice-synthesizer system for selectively articulating messages displayed on a matrix-type message display, comprising:

a matrix-type visual display for displaying messages in alpha-numeric character form in response to matrix drive signals provided on drive signal paths;

a voice synthesizer for articulating words;

control means connected to selected signal paths of said drive signal paths for capturing drive signals unique to a particular message being displayed on said display; and look-up table means storing word entries in uniquely addressable parts thereof;

wherein said control means selects word entries from said look-up table means based on said captured drive signals and outputs said word entries via said voice synthesizer as audible words.

2. The voice-synthesizer system of claim 1, wherein said matrix-type display includes row and column electrodes driven by corresponding row and column signals of said drive signals to provide a displayed message.

3. The voice-synthesizer system of claim 2, wherein said control means captures all of said row and column signals.

4. The voice-synthesizer system of claim 1, wherein said messages displayed by said display includes messages of a first type and messages of a second type, wherein messages of the second type are accompanied by a triggering signal.

5. The voice-synthesizer system of claim, wherein messages of the second type are alarm messages.

6. A voice-synthesizer system for selectively articulating messages displayed on a matrix-type message display, comprising:

a matrix-type visual display for displaying alphanumeric messages in response to matrix drive signals provided on drive signal paths;

a processor which also receives at least some of said matrix drive signals;

a look-up table connected to said processor, wherein said processor identifies an entry in said look-up table based on said matrix drive signals; and a voice synthesizer, controlled by said processor, for articulating words in accordance with said entry of said look-up table identified by said processor based on said matrix drive signals.

7. The system of claim 6, further comprising a trigger signal that enables said voice synthesizer to respond to said processor.

8. The system of claim 6, wherein said matrix-type display includes row and column electrodes driven by corresponding row and column signals of said drive signals to provide a displayed message.

9. The system of claim 8, wherein said processor receives all of said row and column signals.

10. The system of claim 6, wherein said processor receives all of said matrix drive signals.

11. The system of claim 7, wherein said messages displayed by said display includes messages of a first type and messages of a second type, wherein messages of the second type are accompanied by said trigger signal.

12. The system of claim 11, wherein messages of the second type are alarm messages.

13. The system of claim 6, wherein said processor controls said voice synthesizer to repeat said a word or words corresponding to said entry of said look-up table identified by said processor based on said matrix drive signals.

* * * * *